United States Patent [19]

Wulfers

[11] 4,234,434

[45] Nov. 18, 1980

[54] STABILIZATION OF HYDROCRACKED OILS WITH CERTAIN NITROGEN-CONTAINING AROMATIC COMPONENTS

[75] Inventor: Thomas F. Wulfers, Hazel Crest, Ill.

[73] Assignee: Atlantic Richfield Company, Philadelphia, Pa.

[21] Appl. No.: 11,839

[22] Filed: Feb. 14, 1979

[51] Int. Cl.[2] ..... C10M 1/34

[52] U.S. Cl. ..... 252/50; 252/401

[58] Field of Search ..... 252/50, 401

[56] References Cited

U.S. PATENT DOCUMENTS

| | | | |
|---|---|---|---|
| 2,370,552 | 2/1915 | Lincoln et al. | 252/50 X |
| 2,658,925 | 11/1953 | Cenker et al. | 252/401 X |
| 2,824,895 | 2/1958 | Luvisi | 252/401 X |
| 3,217,040 | 11/1965 | Schmerling | 252/401 X |
| 3,402,201 | 9/1968 | Schmerling | 252/401 X |
| 3,642,610 | 2/1972 | Divijak, Jr. et al. | 208/58 |
| 4,036,770 | 7/1977 | Espenscheid et.al. | 252/51.5 R |
| 4,101,430 | 7/1978 | Braid et al. | 252/42.7 |

*Primary Examiner*—Andrew Metz

*Attorney, Agent, or Firm*—Frank J. Uxa, Jr.

[57] ABSTRACT

Hydrocracked lubricating oils are effectively stabilized against deterioration caused by light by the inclusion of at least one of certain nitrogen-containing aromatic components. Such components, e.g., dialkyl anilines, provide outstanding inhibition to sunlight deterioration.

12 Claims, No Drawings

STABILIZATION OF HYDROCRACKED OILS WITH CERTAIN NITROGEN-CONTAINING AROMATIC COMPONENTS

The invention relates to a method of stabilizing a hydrocracked oil. More particularly, it relates to stabilizing such oils against light and/or air deterioration by adding thereto at least one of certain nitrogen-containing aromatic components.

It is known that oils in general will degrade slowly in the presence of light and/or air. Oils such as the economically valuable hydrocracked lubricating oils used in this invention, degrade in light, especially in the presence of air. Since the hydrocracked oils are valuable, there has been considerable effort to find ways to prevent their breakdown due to light and air.

U.S. Pat. No. 4,036,770 teaches a method for stabilizing hydrocracked oils which involves adding nitro-containing aromatic amine components. Such components are relatively expensive and therefore may add significantly to the cost of the hydrocracked oils. Also, such components may impart a less than desirable color to the final product.

U.S. Pat. No. 4,101,430 teaches that oxidative degradation of lubricant compositions containing certain organo sulfur-containing nickel complexes is inhibited.

One object of the present invention is to provide an improved method for stabilizing hydrocracked oils against the deteriorating effects of light.

Another object of the invention is to provide an improved composition of matter involving a hydrocracked oil which has improved inhibition against deterioration by light. Other objects and advantages of the present invention will become apparent hereinafter.

An improved hydrocracked oil composition has now been discovered. This composition comprises a major amount, preferably at least about 70%, by weight of a hydrocracked lubricating oil and a minor amount by weight of at least one added nitrogen-containing aromatic componet having a structure:

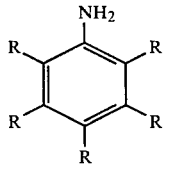

wherein each R is selected from the group consisting of H and substantially aliphatic monovalent hydrocarbonaceous radicals containing 1 to about 24, preferably 1 to about 14 and more preferably 1 to about 10, carbon atoms, such that one R is, preferably two (2) R's are, independently selected from the group consisting of such substantially aliphatic monovalent hydrocarbonaceous radicals.

It is preferred that the hydrocarbonaceous radicals be substantially saturated.

In a preferred embodiment, the added nitrogen-containing aromatic component comprises about 0.05% to about 2.0%, more preferably, about 0.1% to about 1.0%, by weight of the total composition.

The term "hydrocracked lubricating oil" means an oil, preferably a mineral oil, of lubricating viscosity which is derived from a lubricating oil produced by contacting a hydrocarbon feedstock with hydrogen, preferably in the presence of catalyst effective to promote hydrocracking, at hydrocarbon hydrocracking conditions to produce an oil of lubricating viscosity having an increased viscosity index relative to the viscosity index of the hydrocarbon feedstock. In addition, the hydrocracking lubricating oil may be subjected to additional processing, e.g., further contacting with hydrogen-again preferably in the presence of an effective catalyst-, other purifying procedures and the like, to further improve the quality, e.g., color, of the hydrocracked lubricating oil. For example, hydrocracked lubricating oils useful in the present invention may be obtained by the processes disclosed in U.S. Pat. No. 3,642,610, the specification of which is hereby incorporated by reference herein.

Typical examples of the substantially aliphatic monovalent hydrocarbonaceous radicals from which R may be selected includes alkyl such as methyl, ethyl, propyl, butyl, pentyl, hexyl (including cyclohexyl), octyl, decyl, dodecyl, hexadecyl, stearyl and the like; and alkenyl such as ethylenyl, propenyl, butenyl, oleyl, linoleyl and the like. As noted above, it is preferred that such hydrocarbonaceous radicals be substantially saturated.

By "essentially hydrocarbon" (i.e., hydrocarbonaceous) radical is meant those radicals which are composed mainly of hydrogen and carbon, and include such radicals which contain, in addition, minor amounts of substituents, such as chlorine, bromine, sulfur, nitrogen and the like, which do not substantially affect their hydrocarbon character. Preferably, such hydrocarbonaceous radicals include only carbon and hydrogen atoms.

The following examples illustrate more clearly the compositions and methods of the present invention. However, these illustrations are not to be interpreted as specific limitations on this invention.

EXAMPLES

These examples illustrate certain of the benefits of the present invention.

A commercially available hydrocracked oil of lubricating viscosity was selected for testing. This hydrocracked oil had an initial boiling point of 638° F., a viscosity of 150 SUS at 100° F. and a viscosity index of 106. This material was derived using a well known lube oil hydrocracking process.

Various additives were blended into samples of this hydrocracked oil. In order to determine the susceptibility of oils and blends to photo-oxidation, 10 g samples were placed in 250 ml beakers and exposed to 2RS sunlamps at 7 inches on a rotating table for a period of 8 hours.

A substantial amount of sludge was formed in the hydrocracked oil, with no additive, during the eight (8) hour test period. The following is a list of compounds which showed no improvement in reducing sludge formation or color development in the hydrocracked oil when tested at concentrations up to 1.0%:

| | |
|---|---|
| trichloroacetic acid | p-anisidine |
| n-octadecyl mercaptan | diphenyl disulfide |
| N-phenylbenzylamine | N,N-dimethylaniline |
| 2,5-dimethoxyaniline | diphenyl phosphite |
| 2,4,6-trimethylaniline | p-aminophenol |
| o-aminobenzenethiol | o-aminophenol |
| zinc dithiocarbamate | phenyl sulfide |
| ashless dithiocarbamate | benzyl disulfide |
| 4-nitro-2-aminotoluene | 6-nitroquinoline |

-continued

| | |
|---|---|
| 2,5-dimethylacetophenone | o-nitroanisole |
| 2,6-dimethoxyphenol | p-nitrophenol |
| m-xylenediamine | |

The following is a list of compounds, in the hydrocracked oil at concentrations of up to one (1) percent by weight, which showed some improvement in either color or sludge formation:

N,N'-dibenzylethylenediamine
N,N'-dimethylbenzylamine
n-octadecylsulfide
4-methylbenzylamine
N,N-diethyl-p-phenylenediamine
2,4-dimethylphenol
2,6-dimethylphenol
butylatedhydroxytoluene
dodecylphenol In each instance, sludge formation was apparent during the eight (8) hour test.

The following is a list of compounds in the hydrocracked oil at the concentrations noted which showed improvement in color and sludge formation, but did not completely eliminate sludge formation in the eight (8) hour test:

| % Wt. | |
|---|---|
| 0.2 | o-nitrodiphenylamine |
| 0.5 | o-toluidine |
| 0.5 | o-nitroaniline |

The following is a list of compounds in the hydrocracked oil at the concentration noted which completely eliminated sludge formation in the eight (8) hour test:

| % Wt. | |
|---|---|
| 0.5 | 2,5-dimethylaniline |
| 0.4 | 2,4-dimethylaniline |

These results indicate that hydrocracked lubricating oil alone is susceptible to deterioration by sunlight. In addition, various additives are shown to be quite ineffective in reducing this susceptibility.

In contrast, the nitrogen-containing aromatic components, as set forth in the present invention, are shown to provide substantial inhibition of deterioration of hydrocracked oil by sunlight.

Clearly, such results are surprising, particularly in view of the relative ineffectiveness of the other materials tested.

While this invention has been described with respect to various specific examples and embodiments, it is to be understood that the invention is not limited thereto and that it can be variously practiced within the scope of the following claims.

The embodiments of the invention in which an exclusive property or privilege is claimed are defined as follows:

1. A composition of matter comprising a major amount by weight of a hydrocracked lubricating oil and a minor amount by weight of at least one added nitrogen-containing aromatic component having a structure:

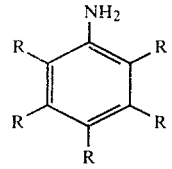

wherein such R is independently selected from the group consisting of H and substantially aliphatic monovalent hydrocarbonaceous radicals containing 1 to about 24 carbon atoms such that two of said R's are substantially aliphatic monovalent hydrocarbonaceous radicals; said nitrogen-containing aromatic component being present in an amount effective to reduce the susceptibility to sunlight deterioration of said hydrocracked oil.

2. The composition of claim 1 wherein said hydrocracked lubricating oil comprises at least about 70% by weight of said composition.

3. The composition of claim 2 wherein said added nitrogen-contaning aromatic component comprises about 0.01% to about 2.0% by weight of said composition.

4. The composition of claim 2 wherein said nitrogen-containing aromatic component comprises about 0.05% to about 2.0% by weight of said composition.

5. The composition of claim 2 wherein said nitrogen-containing aromatic component comprises about 0.10% to about 1.0% by weight of said composition.

6. The composition of claim 5 wherein said substantially aliphatic monovalent hydrocarbonaceous radicals contain 1 to about 14 carbon atoms.

7. The composition of claim 5 wherein said substantially aliphatic monovalent hydrocarbonaceous radicals are substantially saturated and contain 1 to about 10 carbon atoms.

8. A method of inhibiting a hydrocracked lubricating oil from deterioration caused by sunlight comprising combining with said oil an inhibiting amount of at least one nitrogen-containing aromatic component having structure:

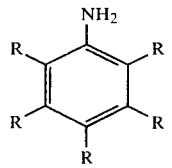

wherein each R is selected from the group consisting of H and substantially aliphatic monovalent hydrocarbonaceous radicals containing 1 to about 24 carbon atoms such that two of said R's are substantially aliphatic monovalent hydrocarbonaceous radicals.

9. The method of claim 8 wherein said nitrogen-containing aromatic component is present in an amount equal to about 0.05% to about 2.0% by weight of the total hydrocracked lubricating oil-nitrogen-containing aromatic component combination.

10. The method of claim 8 wherein said nitrogen-containing aromatic component is present in an amount equal to about 0.10% to about 1.0% by weight of the total hydrocracked lubricating oil-nitrogen-containing aromatic component combination.

11. The method of claim 9 wherein said substantially hydrocarbonaceous monovalent radicals contain 1 to about 14 carbon atoms.

12. The method of claim 10 wherein said substantially hydrocarbonaceous monovalent radicals are substantially saturated and contain 1 to about 10 carbon atoms.

* * * * *